US006108839A

United States Patent [19]

Wu

[11] Patent Number: 6,108,839

[45] Date of Patent: Aug. 29, 2000

[54] MECHANIZED FOLDABLE BED

[75] Inventor: Jack Wu, Taipei, Taiwan

[73] Assignee: Modas Shing Company Ltd., Taiwan

[21] Appl. No.: 09/335,864

[22] Filed: Jun. 17, 1999

[51] Int. Cl.[7] ..... A61G 7/015

[52] U.S. Cl. ..... 5/618; 5/616; 5/174

[58] Field of Search ..... 5/618, 616, 617, 5/613, 174

[56] References Cited

U.S. PATENT DOCUMENTS

| | | | |
|---|---|---|---|
| 4,349,924 | 9/1982 | Zur | 5/618 |
| 4,821,381 | 4/1989 | Bergenwall | 5/618 |
| 5,245,718 | 9/1993 | Krauska | 5/618 |
| 5,608,932 | 3/1997 | Hasegawa | 5/618 |
| 6,006,379 | 12/1999 | Hensley | 5/616 |

*Primary Examiner*—Alexander Grosz
*Attorney, Agent, or Firm*—Jackson Walker L.L.P.

[57] ABSTRACT

A mechanized foldable bed is disclosed. The foldable bed has a front frame assembly and a rear frame assembly pivotal with respect to the front frame assembly. The foldable bed has a motor securely mounted under the bed, a driving rod driven by the motor, a first connecting rod pivotally connected with the driving rod, a second connecting rod pivotally connected with the first connecting rod and a third connecting rod connected with the second connecting rod. A tube securely mounted under the bed is for receiving the second connecting rod therethrough. Furthermore, due to a first connector being securely connected with the front frame assembly and pivotally connected with the driving rod and a second connector pivotally between the rear frame assembly and the third connecting rod, the torso and legs of a patient are supported simultaneously or only the torso.

4 Claims, 7 Drawing Sheets

MECHANIZED FOLDABLE BED

BACKGROUND OF THE INVENTION

1. Field of the Invention

The present invention relates to a mechanized foldable bed, and more particularly to the structure that provides substantial support to a user lying on the bed. The structure uses a single motor and a series of linkages pivotally connected with the motor so as to alternatively provide support to the torso and/or legs of the user.

2. Description of Related Art

A lot of patents addressing the function and structure of a bed for hospital patients are available to the public. Functionally, these beds all have one thing in common, that is to provide support to the torso and legs of a patient lying thereon. Normally, a foldable bed used for a patient has a handle, a shaft connected with the handle and a plurality of linkages pivotally connected with the shaft. When the handle is rotated, the shaft with thread formed thereon will be driven to rotate in the same direction as the handle. The rotation of the shaft will thus drive the rear portion and/or the front portion of the bed and cause them to be lifted upward. Because of the movement of the rear portion and the front portion of the bed, the torso and legs of the patient will be inclined upwardly either separately or simultaneously. The above mentioned structure can provide substantial support to the torso and legs of the patient. However, the operation of this type of bed requires that a person not in the bed manually turn the handle to adjust the bed. To rectify this shortcoming, a new structure was developed that has at least one motor mounted thereunder, so that the upward movement of the front and/or rear portion of the bed is driven by a motor that can be operated by the patient in the bed. The conventional mechanized bed increases the efficiency of providing support to the patient, however it is complex in structure and expensive.

The present invention aims to provide an improved a mechanized foldable bed to obviate and/or mitigate the aforementioned problems.

SUMMARY OF THE INVENTION

The main object of the present invention is to provide a mechanized foldable bed. The structure of the bed enables the rear portion of the bed to move alternatively, so as to provide substantial support to the legs of a patient lying thereon.

Therefore, the patient lying on the bed constructed in accordance with the present invention not only has substantial support to the torso and/or legs but is also moved smoothly movement while the rear portion of the bed is lifted upward.

In order to meet the above objectives, the foldable bed has a front frame assembly composed of a first frame member and a second frame member pivotally connected with the first frame member and a rear frame assembly composed of a third frame member and a fourth frame member pivotally connected with the third frame member. Furthermore, the foldable bed has a motor, a driving rod extendably connected with the motor, a first connecting rod pivotally connected with the driving rod, a second connecting rod pivotally connected with the first connecting rod and a tube securely mounted under the rear frame assembly to receive the second connecting rod therethrough. The first frame member has a first connector securely connected thereunder and pivotally connected with the driving rod. The third frame member has a second connector securely connected thereunder and pivotally connected with the free end of the driven rod. When the motor is activated, the driving rod extends or retracts and the first and the second connecting rods will move accordingly, and the first frame member and the third frame member will be moved. Due to the movement of the first and third frame members, the torso and legs of the patient lying on the bed will be supported to move along with the first and the third frame members. Furthermore, a detaching mechanism is provided under the rear frame assembly to allow detachable engagement with the free end of the second connecting rod, such that when the engagement between the second connecting rod and the detaching mechanism is detached, the free end of the second connecting rod is able to slide in a slot in the mechanism and the third frame member will not be lifted consequently.

The detailed features of the present invention will be apparent in the detailed description with appropriate reference to the accompanying drawings.

DETAILED DESCRIPTION OF PREFERRED EMBODIMENT

Figure 1:
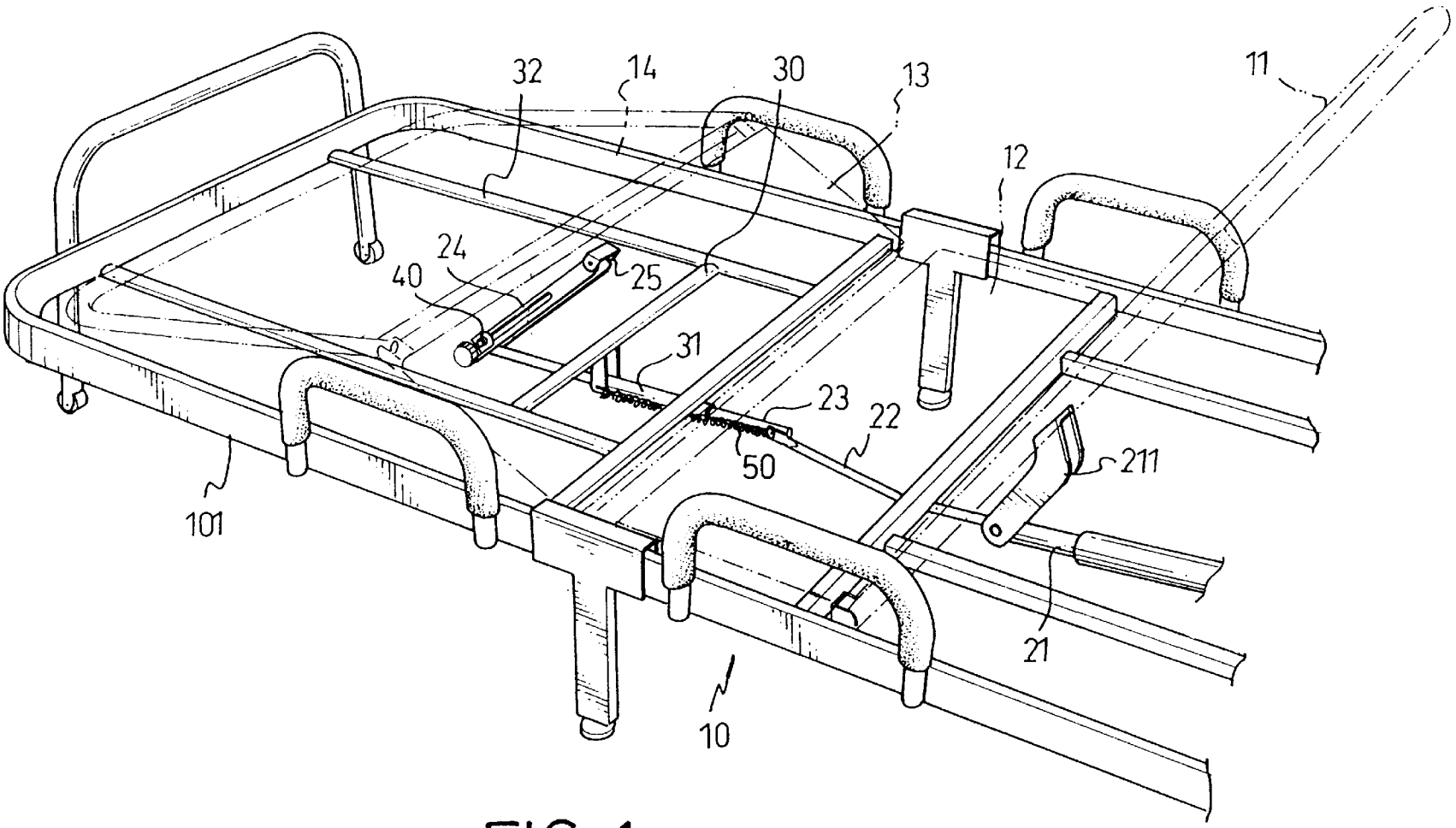
FIG. 1 is a perspective view showing the overall structure of the mechanized foldable bed of the invention.
Figure 2:
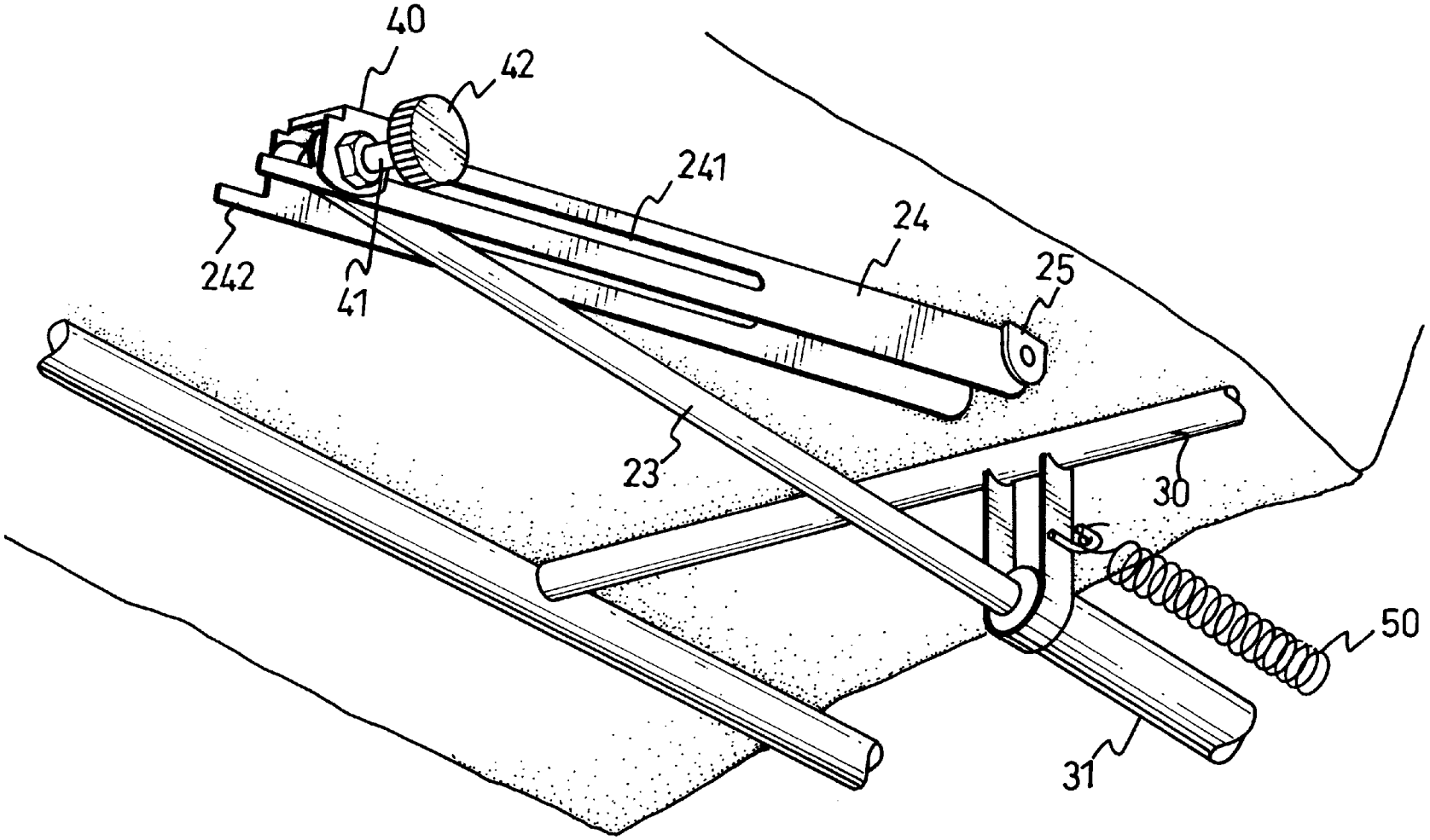
FIG. 2 is perspective view in partial showing the structure and linkage mounted under the bed in accordance with the present invention.

The present invention relates to a mechanized foldable bed. Referring to FIGS. 1 and 2, the foldable bed has a front frame assembly (10) composed of a first frame member (11) and a second frame member (12) pivotally connected with the first frame member (11) and a rear frame assembly (101) composed of a third frame member (13) and a fourth frame member (14) pivotally connected with the third frame member (13). Furthermore, the foldable bed has a motor (20) mounted under the front frame assembly (10), a driving rod (21) extendably connected with the motor (20), a first connecting rod (22) pivotally connected with the driving rod (21), a second connecting rod (23) pivotally connected with the first connecting rod (22), a tube (31) securely mounted under the rear frame assembly (101) for receiving the second connecting rod (23) therethrough and a third connecting rod (24) connected with the free end of the second connecting rod (23). The first frame member (11) has a first connector (211) securely connected thereunder and pivotally connected with the driving rod (21). The fourth frame member (14) has a second connector (25) pivotally connected thereunder and connected with the free end of the third connecting rod (24).

One end of the first connector (211) is securely connected under the first frame member (11) and the other end thereof is pivotally connected with the driving rod (21), such that when the driving rod (21) extends or retracts, the first frame member (11) is able to incline upward or downward with respect to the second frame member (12). Because of the pivotal connection between the first connecting rod (22) and the second connecting rod (23) and the limitation of the tube (31), the second connecting rod (23) is able to initiate the inclined movement of the third frame member (13) with respect to the fourth frame member (14) when the connection between the fourth connecting rod (24) and the second connecting rod (23) is fixed.

Figure 3:
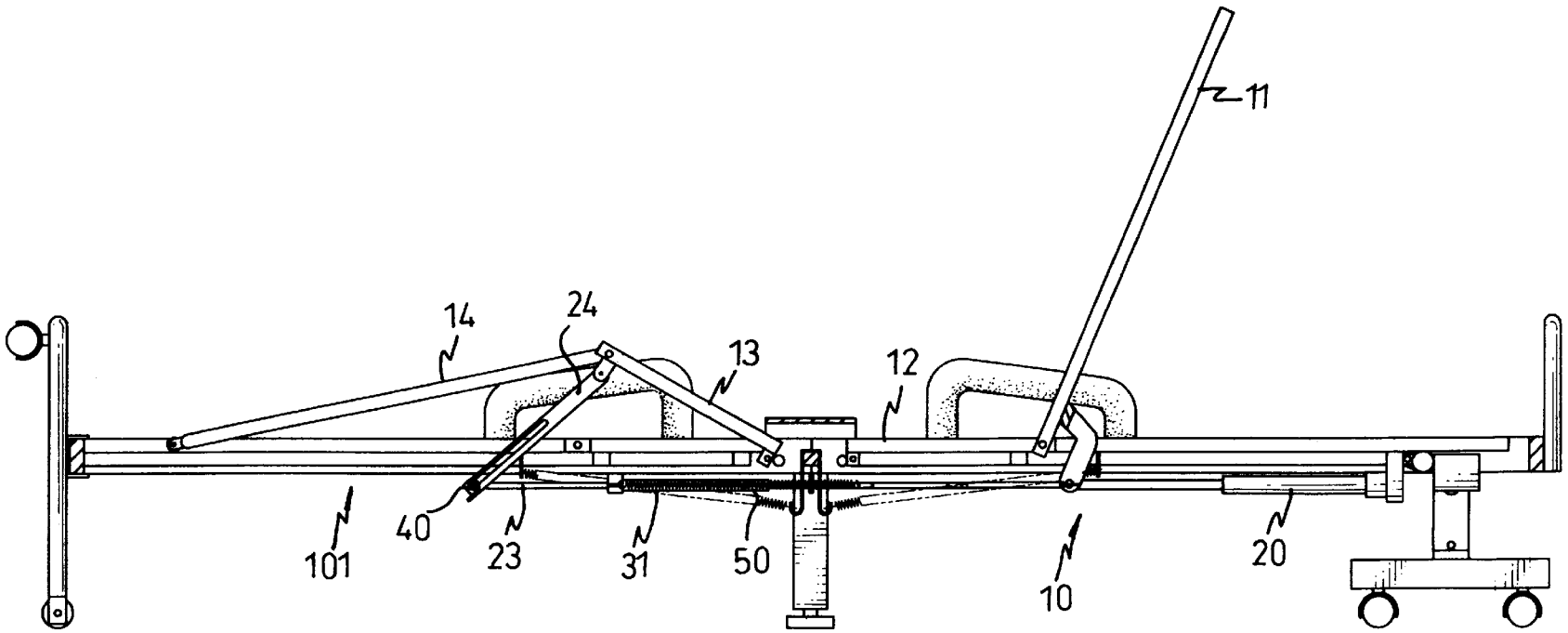
FIG. 3 is a plan view showing the first, the third and the fourth frame members are lifted upward due to the driving of the motor mounted under the bed of the invention.
Figure 4:
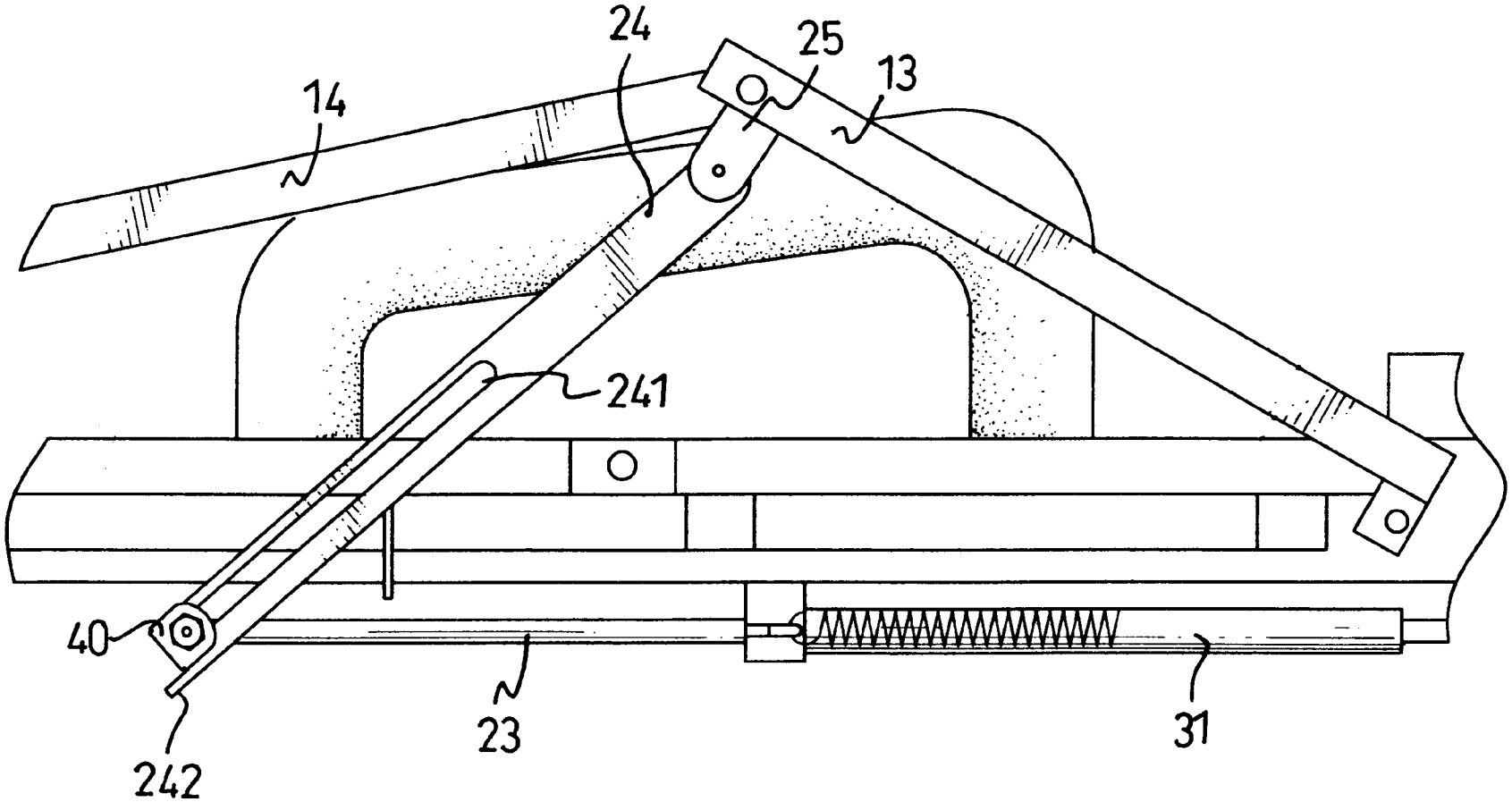
FIG. 4 is a side view showing the upward movement of the third and fourth frame members by the detaching mechanism in accordance with the present invention.
Figure 5:
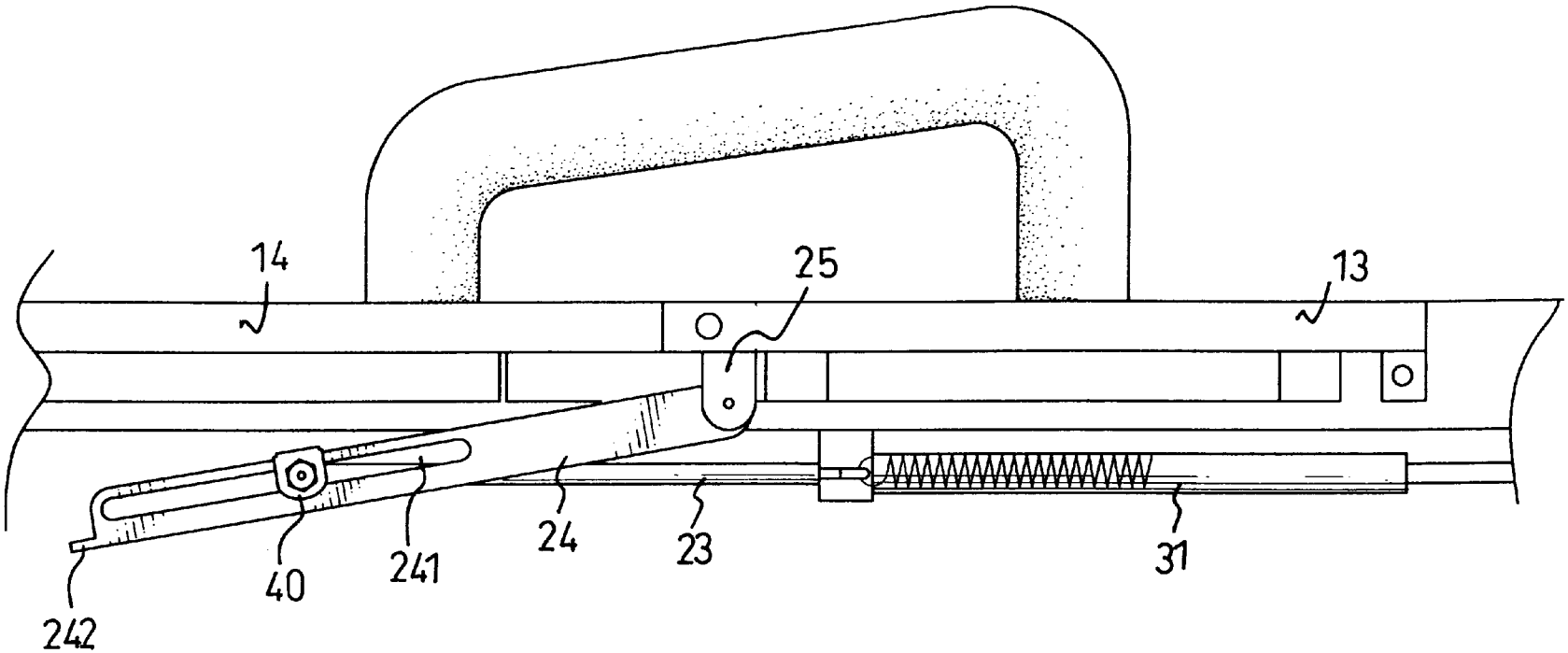
FIG. 5 is a side view of the sliding movement of the third connecting rod in the detaching mechanism to allow the free upward movement of the third and fourth frame members by the driving of the second connecting rod.
Figure 6:
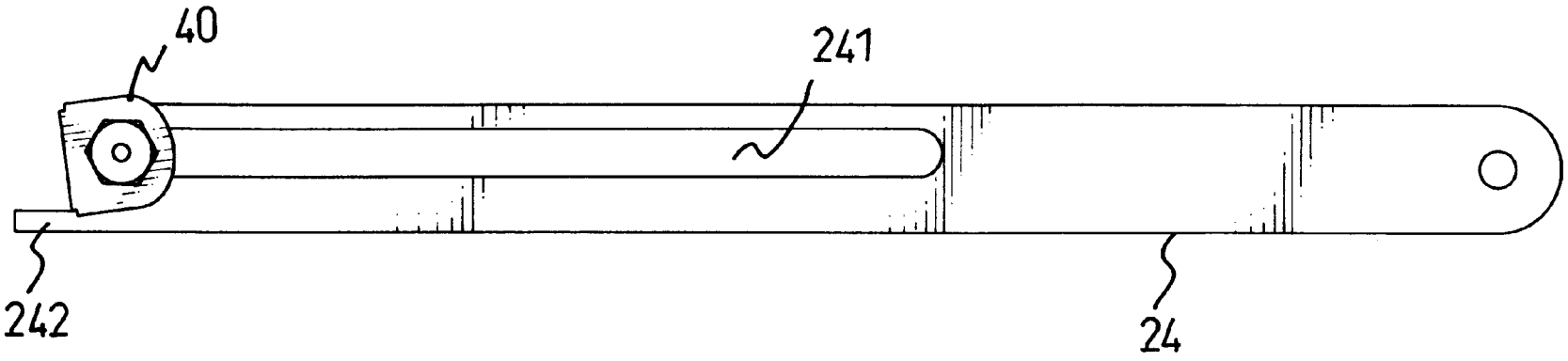
FIG. 6 is a side plan view showing the movement of the cap, whereby allowing the engagement between the cap with the stop.
Figure 7:
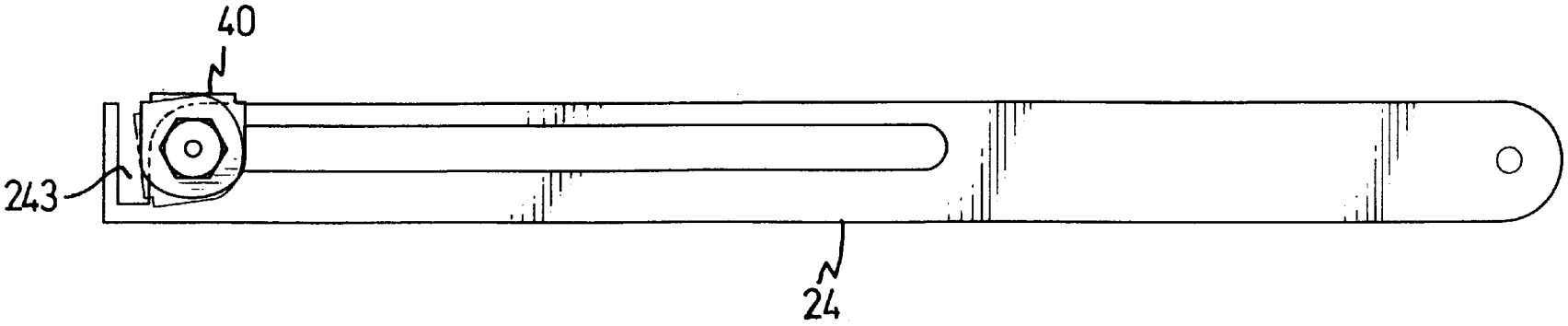
FIG. 7 is a side plan view showing alternative embodiment of the detaching mechanism.

It is noted from FIG. 2 that at the joint between the third connecting rod (24) and the second connecting rod (23), a detaching mechanism is provided to determine the connection relationship between the second and the third connecting rods (23,24). The detaching mechanism has a cap (40) rotatably mounted on top of the third connecting rod (24), a linkage (41) securely connected with the cap (40) and extended through the joint of the second connecting rod (23) and the third connecting rod (24) and a knob (42) securely connected with the linkage (41). The third connecting rod (24) further has a elongate slot (241) defined therein for slidably receiving the linkage (41) therein and a stop (242) formed on the distal end thereof and detachably engaged with the cap (40). The cap (40) is able to be driven by the knob (42) to rotate with respect to the third connecting rod (24). When the end of the cap (40) engages with the stop (242), the linkage (41) is not able to slide in the slot (241). Then, the connection between the second connecting rod (23) and the third connecting rod (24) is fixed. Accordingly, retraction of the second connecting rod (23) will initiate the lift of the third frame member (13) to support the torso of the patient lying on the bed, as shown in FIG. 3. However, referring to FIGS. 4 and 5, if the cap (40) is not rotated with respect to the third connecting rod (24), the second connecting rod (23) and the third connecting rod (24) maintain pivotal connection. That is, the cap (40), the linkage (41) and the knob (42) are integrally slidable along the slot (241) of the third connecting rod (24). Thus, retraction of the second connecting rod (23) will not be able to initiate the upward movement of the third frame member (13). FIGS. 6 and 7 show two different embodiments of the third connecting rod (24) of the invention. It is noted from FIG. 6 that the distal end of the third connecting rod (24) has a stop (242) formed thereon to stop the rotation of the cap (40). FIG. 7 shows that the distal end of the third connecting rod (24) has a cutout (243) defined therein for receiving and securing the cap (40) therein. Both the structure in FIG. 6 and FIG. 7 can accomplish the purpose of stopping the rotation of the cap (40).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mechanized foldable bed structure having a front frame assembly (10) composed of a first frame member (11) and a second frame member (12) pivotally connected with the first frame member (11) and a rear frame assembly (101) composed of a third frame member (13) pivotally connected with the second frame member (12) and a fourth frame member (14) pivotally connected with the third frame member (13), the structure comprising:

a motor (20) securely mounted under the bed;

a driving rod (21) extendably connected with the motor (20);

a first connecting rod (22) pivotally connected with the driving rod (21);

a second connecting rod (23) pivotally connected with the first connecting rod (22);

a tube (31) securely connected with the bed for receiving the second connecting rod (23) therethrough;

a third connecting rod (24) detachably connected with the second connecting rod (23) and having an elongate slot (241) defined therein;

a first connector (211) securely connected under the first frame member (11) and pivotally connected with the driving rod (21); and a second connector (25) connected under the third frame member (13) and with the third connecting rod (24).

2. The structure as claimed in claim 1 further having a detaching mechanism provided between a joint of the second connecting rod (23) and the third connecting rod (24), wherein the detaching mechanism has a cap (40) rotatably mounted on the third connecting rod (24), a linkage (41) securely connected with the cap (40) and extended through the joint of the second connecting rod (23) and the third connecting rod (24) and a knob (42) securely connected with the linkage (41).

3. The structure as claimed in claim 2, wherein a stop (242) is formed on the distal end of the third connecting rod (24) to stop the rotation of the cap (40), whereby the connection between the second connecting rod (23) and the third connection rod (24) is secured.

4. The structure as claimed in claim 2, wherein a cutout (243) is defined in the distal end of the third connecting rod (24) for receiving the cap (40) therein so as to stop the rotation of the cap (40).

* * * * *